United States Patent [19]

Smith

[11] 4,270,686

[45] Jun. 2, 1981

[54] ROVING BRAKE

[76] Inventor: Robert L. Smith, 435 Fair Dr., Costa Mesa, Calif. 92626

[21] Appl. No.: 857,229

[22] Filed: Dec. 5, 1977

[51] Int. Cl.[3] ..... B65H 23/28; B65H 23/08; B65H 59/12

[52] U.S. Cl. ..... 226/195; 242/154; 242/147 R

[58] Field of Search ..... 226/195, 102, 144, 145, 226/151, 198, 196, 39; 242/149, 154, 147 R, 129.8, 129.1; 188/65.4, 65.5; 19/160

[56] References Cited

U.S. PATENT DOCUMENTS

| | | | |
|---|---|---|---|
| 3,083,437 | 4/1963 | Davis | 19/160 |
| 3,385,491 | 5/1968 | Helms | 226/39 |
| 3,902,679 | 9/1975 | Bost | 242/129 |
| 3,904,145 | 9/1975 | Steinberger | 226/195 |

*Primary Examiner*—Robert B. Reeves
*Assistant Examiner*—Brian Bond
*Attorney, Agent, or Firm*—Freilich, Hornbaker, Wasserman, Rosen & Fernandez

[57] ABSTRACT

A device that permits the rapid removal of fiber glass roving from a coil thereof, for movement of the roving to a chopping and spraying gun, wherein the device provides considerable drag to the roving when it is no longer pulled firmly. The device includes a tube that is pivotally mounted on a support, so that the tube can pivot to best align itself with roving moving, therethrough, and then can pivot away from that orientation to cause the roving to undergo sharper bends in passing into and out of the tube, so as to apply braking forces to the roving. The support for the tube can include a pair of rods that fit closely within the corners of a standard roving box, and can also include clamps on the rods that clamp to the box, for facilitating mounting of the tube.

3 Claims, 4 Drawing Figures

ROVING BRAKE

BACKGROUND OF THE INVENTION

This invention relates to a roving brake for retarding the movement of strands of fiber glass or other material therethrough.

Many structures are constructed by spraying a resin and chopped fiber glass roving simultaneously onto a work piece, by the use of a resin spray gun which carries a roving chopper thereon. In the use of the spray gun, fiber glass roving is rapidly removed from a box containing a large coil roving, and is guided along an overhead guideway on a boom that extends to the gun location, while the gun chopper rapidly chops the roving and sprays it out. The gun is often stopped and restarted. When the gun stops, the rapid moving roving continues to feed out of the coil for a large fraction of a second. As a result, large loops of free roving are created outside the box and at the spray gun. The loops often lie on a floor that may contain stray resin or other contaminants which can be picked up by the roving to later dirty or jam the cutter and harm the sprayed work piece. Also, it is found that the roving loop can form knots that jam on the guide waves and cause breakage of the roving when it is next pulled, requiring the operator to spend time to thread the roving through the guide ways and gun chopper. A simple device which could be easily mounted in place and which could minimize the feeding out of roving when the spray gun no longer pulls it, and yet which could freely feed out the roving when the spray gun began to pull it again, would facilitate the use of roving.

SUMMARY OF THE INVENTION

In accordance with one embodiment of the present invention, a roving brake is provided which enables roving to be freely pulled from a coil in a box toward a chop and spray gun or other device, while also rapidly decelerating the roving when it ceases to be pulled. The apparatus includes a tube through which roving passes, and a support that can pivotally support the tube over a coil of roving, to permit the tube to pivot from a largely vertical orientation wherein it freely passes roving therethrough, to a tilted position wherein it retards the passage of roving therethrough. The apparatus also includes a means, such as a weight or spring, for urging the tube towards the tilted position. The large tension applied to the roving when it is pulled rapidly passing through the tube, causes the tube to pivot, against the biasing force, towards a largely vertical position wherein the roving undergoes minimal bending in passing into and passing out of the tube. When the roving is no longer rapidly pulled through the tube, the biasing force pivots the tube to its tilted position to retard the passage of roving therethrough.

The support can include a cylinder surrounding the lower end of the tube, with the cylinder having a flared lower end to help guide the roving into the tube. Also, the support can include a pair of elongated members extending downwardly from the cylinder, with the lower end portions of the members extending parallel to one another and at a spacing that permits them to fit closely within the corners of a box which holds a coil of roving material. A pair of clamps securely hold the members to the box.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
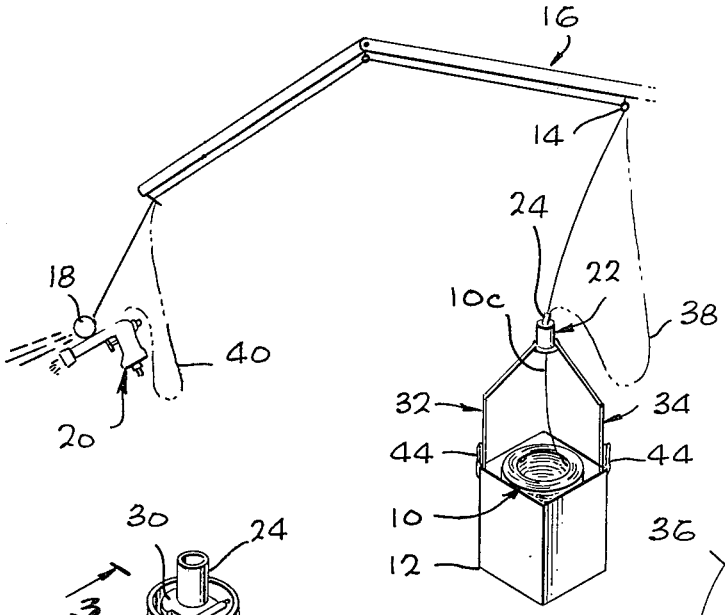
FIG. 1 is a perspective view, showing a roving brake constructed in accordance with the invention, and showing the manner in which it is utilized to pass roving along a guideway to a spray gun.

As shown in FIG. 1, a large coil of fiber glass roving 10*c* is typically supplied in a carboard box 12 having sides of about 1 foot width. The roving is utilized by feeding it through guides 14 on a boom 16, and to the chopper 18 of a spray gun device 20. When the gun is operated, rollers in the chopper pull the roving rapidly therethrough to chop it into small lengths and spray it at a workpiece. The chopper rollers move the roving rapidly from the coil, and when the gun is stopped, the momentum of the roving causes it to continue to feed off the coil 10. In order to minimize the amount of roving fed from the coil after the gun stops pulling the roving, a guide and brake 22 is provided through which the roving extends.

Figure 2:
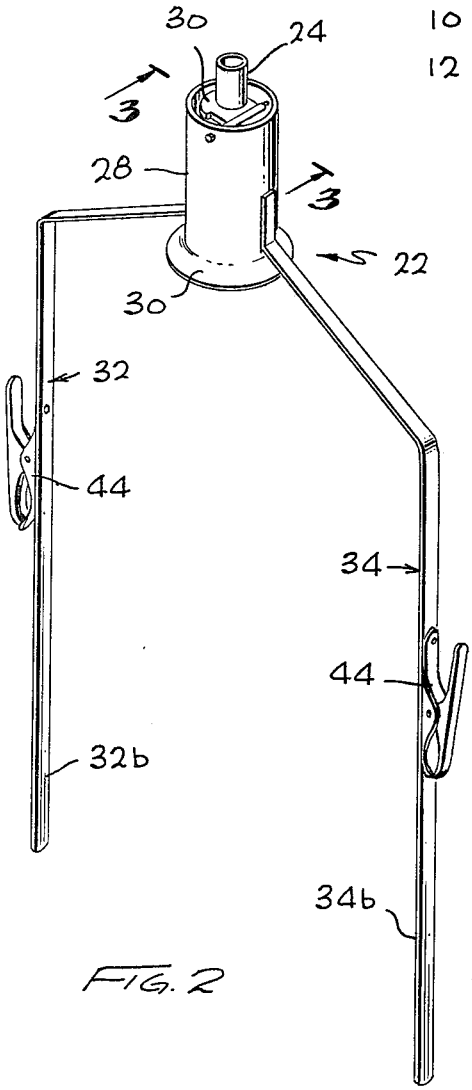
FIG. 2 is a perspective view of the roving brake of FIG. 1, shown with the roving guiding tube in a substantially vertical orientation.
Figure 4:
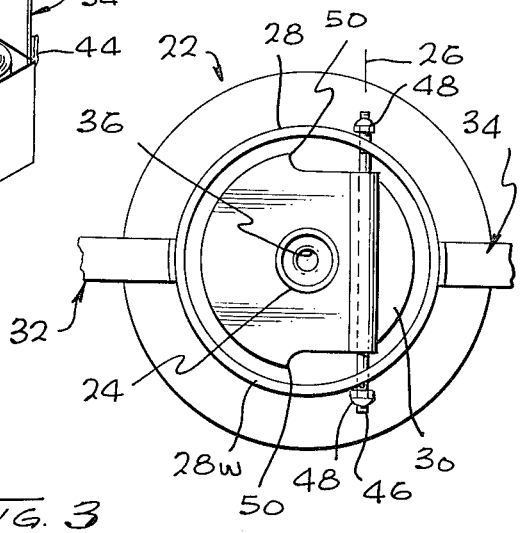
FIG. 4 is a plan view of the apparatus shown in FIG. 3, with the tube in a largely vertical position.
Figure 3:
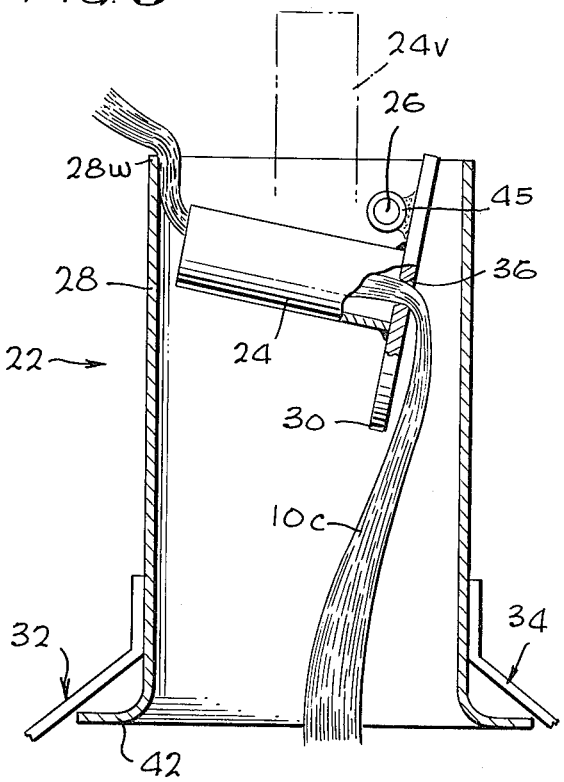
FIG. 3 is a view taken on the line 3—3 of FIG. 2, shown with the roving guiding tube in a tilted position.

As also shown in FIGS. 2–4, the brake 22 includes a tube 24 through which the roving 10 extends in movement from the coil 10*c* to the guides 14 and to the gun 20. The tube is pivotally mounted about an axis 26 (FIG. 3), on a surrounding guide cylinder 28. The tube 24 can pivot up to a substantially vertical orientation, as indicated in phantom at 24*d* in FIG. 3, to facilitate the rapid passage of roving therethrough when the roving is being fed to the gun. However, the tube is biased to move towards the tilted position shown in solid lines in FIG. 3, by reason of the pivoting axis 26 being offset from the center of gravity of the tube 24 and of a mounting base 30 to which the tube is held. The cylinder 28 which surrounds the tube, is supported on a pair of elongated members or rods 32, 34 that are mounted on the box that holds the coil of roving. The rods have upper ends coupled to the tube 24 through the cylinder 28, and lower ends positioned on either side of the roving coil.

When the roving 10 is not being pulled by the gun, so that the roving is not under a substantial tension, the tube 24 can lie in its tilted position as shown in FIG. 3. In this position, the roving 10 must bend in passing into the tube, especially through a narrow opening 36 in the supporting plate 30 at the bottom of the tube. Also, the roving may have to undergo an additional bending in passing out through the top of the tube 24. However, when the gun begins pulling on the roving to apply tension thereto, the tension causes the tube 24 to pivot up to its nearly vertical position at 24*v*. In this orientation of the tube, the roving does not have to bend sharply in passing through the opening 36 near the bottom of the tube, and does not have to undergo a sharp change in direction in passing out through the top of the tube. At the time when the gun is deactivated so that it ceases to pull on the roving, and the roving continues to move towards the overhead guides 14, the decrease in roving tension will permit the tube to move down to its tilted position, at which it forces the roving to undergo a sharp bend in entering the tube, and also in leaving the tube for roving moving upwardly. As a result, the tube applies additional friction to the roving, to minimize the amount of free roving that will pass out of the tube and form the loops 38, 40 shown in FIG. 1. It also may be noted that the roving brushes against the top wall portion of the cylinder 28, at the wall location 28*w*, when the tube moves to its tilted position and the roving passes out of the tube, to provide additional retardation to the roving by bending the roving between wall 28*w* and the tube upper end, especially for roving moving to the side. Thick roving can be directly pressed between the tube upper end and the cylinder.

It is possible to mount the tube in a fixed orientation, instead of pivotally mounting it as shown, and it is found that the tube in this orientation provides some retardation to the roving. However, if the tube cannot pivot, then when the gun is rapidly drawing the roving therethrough, the tube will not necessarily be oriented in the best position for minimizing friction on the roving. The pivotally mounted tube 24 of the present invention, will adjust its orientation, so that there is minimal bending of the roving in entering the tube at 36 and leaving it at the top of the tube. This not only lowers the force that the gun must apply to move the roving, but also minimizes the amount of wear of the roving on the tube 24 and on the walls of the hole 36 in the lower plate under the tube. Fiberglass roving is abrasive, and will more quickly wear a surface around which it must undergo a greater amount of bending when moving rapidly thereby.

The cylinder 28 which surrounds the lower end of the tube, has a flared lower end portion 42. This flared portion can help to guide the roving into the tube 24, to minimize friction and breakage of the roving. The roving can whip around as it is deployed off the inside of a large coil, and the lower end of the cylinder helps to direct the roving in movement towards the tube.

The rods 32, 34 are constructed with lower end portions 32*b*, 34*b* (FIG. 2) that are substantially parallel, and that are spaced apart by a distance such as 1½ feet to closely fit within the corners of a typical roving-holding box of a square cross section of one foot on each side. In addition, a clamp 44 is provided on the lower portion of each rod to clamp to the box. The fact that the rods lie in the corners of the box, results in their being relatively stably held therein, especially in conjunction with the clamps that clamp onto the corners of the boxes. It may be noted that most roving supplied for chop and spray guns, come in boxes that are 12 inches or 14 inches wide, so that rods spaces 17 inches apart, or about 1½ feet, will closely fit the small boxes and almost reach the corners of the larger boxes.

The brake can be constructed as indicated in FIG. 4 by welding a tube 24 onto a plate 30 with a small hole 36 therein, welding another tube 45 onto the plate, and passing a stud 46 through the tube 45 and through corresponding holes formed in cylinder 28. A pair of retainer nuts 48 can be threaded onto the opposite ends of the stud to hold it in place and permit the tube and plate to pivot on the cylinder. The plate 30 can be formed with stops 50 that engage the inside of the cylinder, to prevent the tube 24 from pivoting more than about 80° from its vertical position even if a thin roving is passing through the tube.

Thus, the invention provides a roving brake which can be easily mounted and which is effective in limiting the size of free loops of roving, when the roving, after having been rapidly pulled out from the coil, is suddenly no longer being pulled out. This can be accomplished by utilizing a narrow tube through which the roving passes, and by pivotally mounting the tube on a support. The support can include a cylinder much larger than the tube, and having an outwardly flared lower end, to guide the roving into the tube. The tube can tilt far enough to press the roving between the tube upper end and the inside of the cylinder. The support can also include a pair of bars that extend downwardly, and that have parallel lower portions formed to fit snugly within the corners of a box that carries a coil of roving. A pair of clamps on the lower bar portions can securely clamp the bars to the box.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A roving brake for controlling the movement of roving from a coil thereof that lies in a box, to a largely overhead guide, comprising:

a support which includes a cylinder for extending along a vertical axis, said cylinder having an outwardly flared lower end, a pair of bars on opposite sides of the cylinder, said bars having upper bar ends connected to said cylinder and lower bar ends for extending into the corners of the coil-holding box, and a pair of clamps on the outer sides of the bars for clamping to the box; and a tube pivotally mounted on said cylinder between a vertical position wherein said tube is oriented with its axis largely parallel to the axis of the cylinder, and a tilted position wherein the upper end of the tube is tilted from said vertical position.

2. A roving brake for enabling roving to be freely pulled rapidly thereby from a coil of roving typically held in a box, toward a chopper and spray gun or other device, while also rapidly decelerating the roving when it ceases to be pulled, comprising:

a tube;

support means for pivotally supporting said tube over a coil of roving, to permit said tube to pivot from a largely vertical first orientation, to freely pass roving therethrough, to a tilted position tilted from said first orientation to retard the passage of roving therefrom; and means for biasing said tube toward said tilted position;

said support means including a pair of elongated members having upper ends coupled to said tube and parallel lower end portions, and also including a pair of downwardly facing clamps for clamping to the box, each of said clamps lying a distance above the bottom of said members, so that the bottoms of the members can lie within the corners of the box.

3. A roving brake for enabling roving to be freely pulled rapidly from a coil of roving that lies in a box, to guide it upwardly and toward a chop and spray gun, while also rapidly stopping roving movement when the roving ceases to be pulled, comprising:

a tube; and a support pivotally supporting said tube over said coil, to enable pivoting of the tube by forces applied by the roving to the tube, so that the tube lies at an orientation that minimizes bending of roving that passes form the coil to the guides when the roving is pulled to move rapidly through the tube, said tube being biased to tilt toward a second orientation at which the roving generally undergoes more bending than at said first mentioned orientation so that the tube tilts towards said second orientation when the roving is not pulled to moved through the tube;

said support including a cylinder with an outwardly flared lower end for helping to guide roving toward the tube and an upper cylinder portion, said tube lying at the upper portion of said cylinder.

* * * * *